United States Patent [19]

Brücher et al.

[11] Patent Number: 4,858,684

[45] Date of Patent: Aug. 22, 1989

[54] HEAT EXCHANGER, ESPECIALLY FOR COOLING CRACKED GAS

[75] Inventors: Peter Brücher; Helmut Lachmann, both of Berlin, Fed. Rep. of Germany

[73] Assignee: Borsig GmbH, Berlin, Fed. Rep. of Germany

[21] Appl. No.: 193,116

[22] Filed: May 11, 1988

[30] Foreign Application Priority Data

May 12, 1987 [DE] Fed. Rep. of Germany ..... 3715713

[51] Int. Cl.[4] ..... F28F 13/00

[52] U.S. Cl. ..... 165/134.1; 165/135; 208/48 R

[58] Field of Search ..... 165/134.1, 135; 208/48 R

[56] References Cited

U.S. PATENT DOCUMENTS

| | | | |
|---|---|---|---|
| 3,071,540 | 1/1963 | McMahon et al. | 208/48 R |
| 3,802,497 | 4/1974 | Kümmel et al. | 165/158 |
| 4,294,312 | 10/1981 | Kehrer et al. | 165/134.1 |
| 4,346,758 | 8/1982 | Kehrer et al. | 165/134.1 |
| 4,537,249 | 8/1985 | Harris | 165/134.1 |
| 4,589,473 | 5/1986 | Kehrer | 208/48 R |
| 4,647,436 | 3/1987 | Herbort et al. | 165/134.1 |
| 4,700,773 | 10/1987 | Kehrer | 165/134.1 |

FOREIGN PATENT DOCUMENTS

| | | | |
|---|---|---|---|
| 2053444 | 2/1981 | United Kingdom | 165/135 |

*Primary Examiner*—Ira S. Lazarus
*Assistant Examiner*—Christopher Hayes
*Attorney, Agent, or Firm*—Max Fogiel

[57] ABSTRACT

A heat exchanger is especially for cooling cracked gases with boiling water. It consists of pipes (1) that the gas to be cooled flows through and that are surrounded by a cooling jacket with a coolant flowing through it. The end of each pipe that faces the gas intake is surrounded by a sleeve. The coolant flows through the sleeve. The volume of coolant flowing through the sleeve is less than the heat supplied from the gas being cooled. (FIG. 1).

5 Claims, 3 Drawing Sheets

HEAT EXCHANGER, ESPECIALLY FOR COOLING CRACKED GAS

Figure 1:
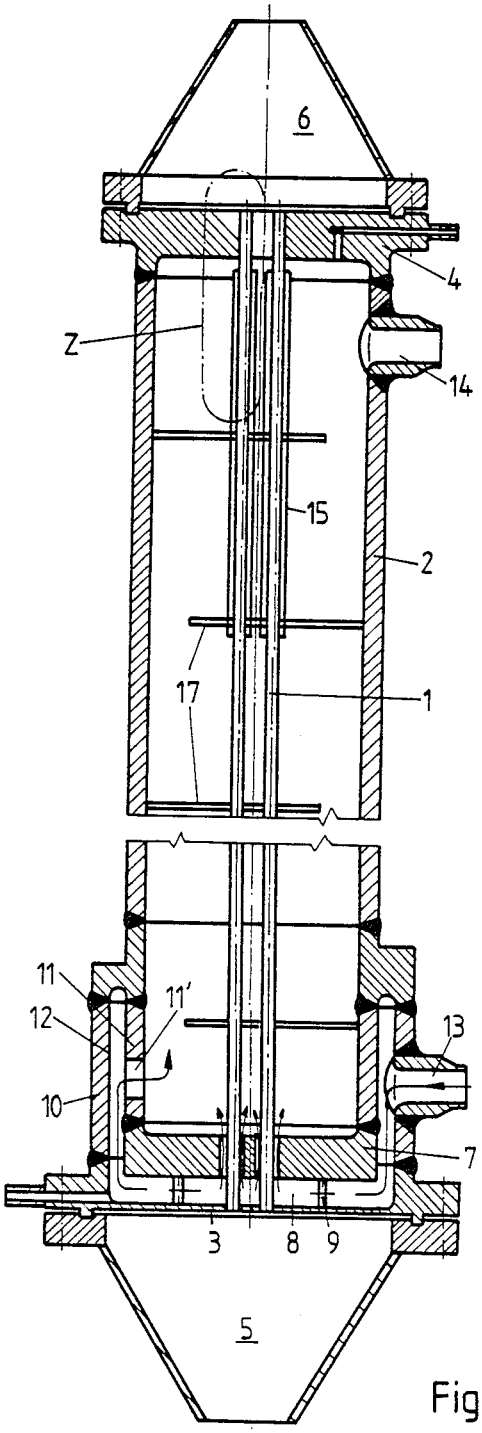

This invention concerns a heat exchanger, especially for cooling cracked gas, as recited in the preamble to claim 1.

The gases generated when hydrocarbons are thermally cracked are cooled very rapidly to stabilize their molecular composition. The process consists of the indirect transmission of heat from the cracked gas to a heat-absorbing medium in cracked-gas coolers. The gas is conveyed through pipes surrounded by a coolant in the form of evaporating water. The water cools the pipes very rapidly as it evaporates, maintaining the temperature of their walls very low, only slightly above that of the water. The gas is a mixture of hydrocarbons of various molecular weights and partial pressures. The temperature of some of the constituents can be below their condensation point while the gas is being cooled in the cooler, and they tend at those temperatures to precipitate onto the walls of the pipes and create what are called coke beds. The coke bed increases flow impedance and accordingly the pressure of the gas in the upstream cracking furnace. Poorer yields of cracked gas, increased elevation of the coke bed, and elevated gas-exit temperatures in conjunction with less steam are the consequences. The cooler must be taken out of operation to remove the coke bed after a while.

The exit-end of the gas-conveying pipes in a heat exchanger for cooling cracked gas and other gas that is known from U.S. Pat. No. 3,802,497 is surrounded by an outer pipe that opens into the atmosphere in order to decrease the formation of a coke bed. The result is a layer of quiescent air between the gas-conveying pipe and the outer pipe. A double-walled pipe of this type impedes heat loss to such an extent that the gas does not get cool enough.

The object of the invention is to improve the generic heat exchanger to the extent that the cooling action at the exit end of the gas-conveying pipes is decreased just enough to extensively eliminate the formation of a coke bed.

This object is attained in a generic heat exchanger by the characteristics recited in claim 1. Practical embodiments of the invention are recited in the subsidiary claims.

The rear end of the pipe does not get wet with as much coolant in the heat exchanger in accordance with the invention. The cooling action is accordingly less effective, and the temperature at the inner surface of the gas-conveying pipe is above the condensation point of the cracked-gas constituents. The degree of cooling can be varied by varying either the width of the gap between the gas-conveying pipe and the sleeve pipe that surrounds it or the thickness or density of the wire mesh, adapting the heat exchanger to the particular operating conditions.

Several embodiments of the invention are illustrated in the drawing and will now be specified.

Figure 2:
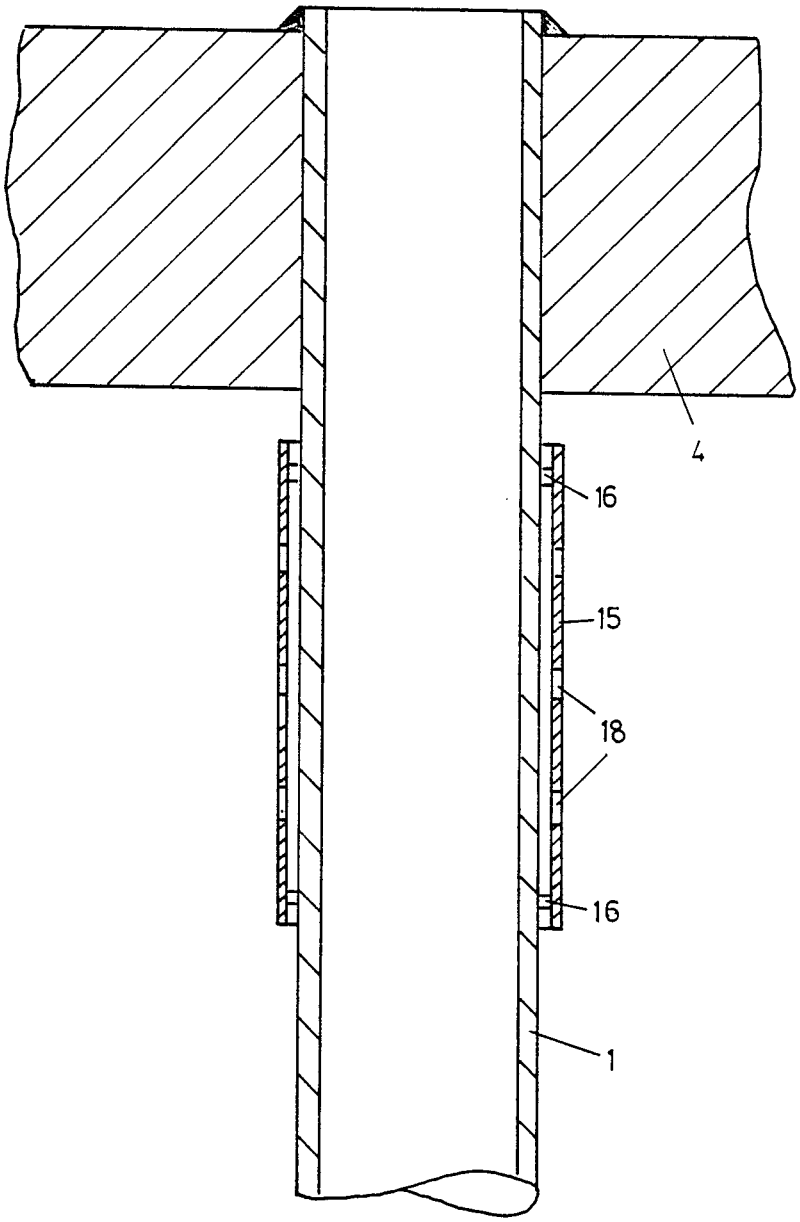
Figure 3:
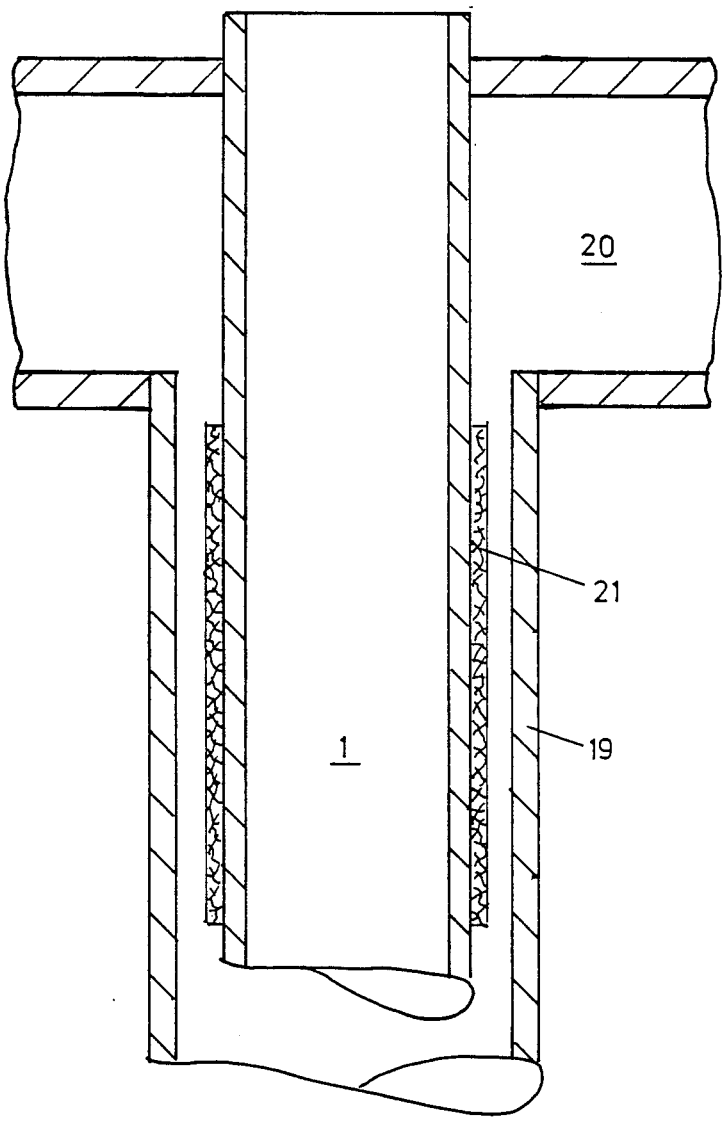

FIG. 1 is a longitudinal section through exchanger in accordance with the invention, FIG. 2 illustrates the detail Z in FIG. 1, and FIG. 3 illustrates the same detail Z in another embodiment.

The illustrated heat exchanger is of the upright type and is especially intended for cooling cracked gas by means of compressed evaporating water. It consists of a nest of individual pipes 1, through which flows the gas to be cooled and which are surrounded by a jacket 2. Pipes 1 are secured in two pipe slabs 3 and 4, communicating with which are a 13 gas-intake chamber 5 and a gas-outlet chamber 6.

The end of the thin pipe slab 3 at the gas-intake end that faces away from gas-intake chamber 5 is supported on a slab 7, leaving a space 8 between it and slab 3. Distributed over the cross-section between thin pipe slab 3 and supporting slab 7 are supporting fingers 9 shaped onto the supporting slab. Each pipe 1 extends loose through supporting slab 7, leaving an annular gap. Thin pipe slab 3 is connected to an outer annular jacket 10 and supporting slab 7 to an inner annular jacket 11. Annular jackets 10 and 11 are connected together and demarcate an annular chamber 12, into which extends an intake connection 13 for the water that acts as a coolant. The top of jacket 2 is provided with an outlet connection 14 for removing the coolant. Jacket 11 has an outlet 11'.

The end of pipe 1 that faces gas-outlet chamber 6 is surrounded by a sleeve. The sleeve illustrated in FIGS. 1 and 2 consists of a sleeve pipe 15 that is open at each end and that surrounds pipe 1 without contacting it, leaving an annular gap. To maintain the gap at a constant width, sleeve pipe 15 rests on spacers 16 on pipe 1. The sleeve pipes 15 are secured in reinforcing disks 17 positioned inside jacket 2 and perpendicular to its axis and intended to prevent pipe 1 from vibrating. The length of sleeve pipe 15 is adapted to the operating conditions and the pipe ends just in front of the pipe slab 4 at the gas-exit end.

The annular gap between pipe 1 and sleeve pipe 15 is wide enough to prevent enough of the boiling water in jacket 2 from flowing into it to thoroughly wet it. The accordingly reduced or impeded wetting of pipe 1 with boiling water decreases the transfer of heat from the heat-releasing to the heat-absorbing medium and accordingly reduces the cooling action. The less intense cooling leaves the temperature of the pipe wall higher, so that little or no hydrocarbons will precipitate. The result is little or no coke bed.

The extent that the cooling action is reduced to can be affected by varying the width of the gap. Perforations 18 can also be provided in the wall of sleeve pipe 15 for the boiling water to penetrate into the annular gap through and augment the cooling action again.

The invention can be employed with both pipe-nest heat exchangers (FIGS. 1 & 2) and double-walled pipe heat exchangers. FIG. 3 is a section through a double-walled pipe heat exchanger. Each gas-conveying pipe 1 is surrounded by an outer pipe 19, leaving an annular gap between them. The gap communicates with an intake-and-outlet chamber 20 that is common to a number of double-walled pipes.

The end of the gas-conveying pipe 1 that faces outlet chamber 20 can as described herein be surrounded by a sleeve pipe 15 that ends just in front of the chamber or extends partly into it. FIG. 3 illustrates another way of accommodating gas-conveying pipe 1 that can also be employed if desired with the pipe-nest heat exchanger illustrated in FIGS. 1 and 2. This means of accommodation consists of a wire mesh 21 that is drawn like a sock over pipe 1. Wire mesh 21, like sleeve pipe 15, prevents the section of pipe 1 14 that is at risk from getting wet.

What is claimed:

1. A heat exchanger for cooling cracked gases by boiling water, comprising: pipes having an inner wall of conducting gas to be cooled; a cooling jacket surrounding said pipes; cooling medium for flowing through said jacket; sleeve means, each of said pipes having a gas outlet end surrounded by said sleeve means; said cooling medium flowing through said sleeve means; said sleeve means comprising a sleeve pipe open at both ends and out of contact with said gas conducting pipes; said sleeve pipe having a wall with perforations.

2. A heat exchanger for cooling cracked gases by boiling water, comprising: pipes having an inner wall for conducting gas to be cooled; a cooling jacket surrounding said pipes; cooling medium flowing through said jacket; sleeve means, each of said pipes having a gas outlet end surrounded by said sleeve means; said sleeve means comprising a wire mesh resting against each of said pipes.

3. A heat exchanger for cooling cracked gases by boiling water, comprising: pipes having an inner wall for conducting gas to cooled; a cooling jacket surrounding said pipes; cooling medium for flowing through said jacket; sleeve means, each of said pipes having a gas outlet end surrounded by said sleeve means; said cooling medium flowing through said sleeve means at a quantity that is less than the quantity needed when said gas conducting pipe is moistened over its entire surface.

4. A heat exchanger for cooling cracked gases by boiling water, comprising: pipes having an inner wall for conducting gas to be cooled; a cooling jacket surrounding said pipes; cooling medium for flowing through said jacket; sleeve means, each of said pipes having a gas outlet end surrounded by said sleeve means; said gas outlet end having a cooling effect which is reduced so that the temperature at the inner wall of said pipes lies above the condensation temperature of components of the cracked gas, cooling of said gas remaining substantially unreduced above a predetermined level; said sleeve means comprising a sleeve pipe open at both ends and out of contact with said gas conducting pipes; said sleeve pipe having a perforated wall; said cooling medium having a flow-through quantity that is less than the quantity needed when said gas conducting pipe is moistened over its entire surface; heat released by said gas being less than the heat removed by said cooling medium.

5. A heat exchanger as defined in claim 4, wherein said sleeve pipe having said perforated wall comprises a wire mesh.

* * * * *